United States Patent [19]

Tetro

[11] 4,238,261

[45] Dec. 9, 1980

[54] METHOD FOR FORMING A ZERO TAIL LENGTH SPLICE IN A MOVING WEB

[75] Inventor: Richard S. Tetro, Fulton, N.Y.

[73] Assignee: The Black Clawson Company, Fulton, N.Y.

[21] Appl. No.: 947,879

[22] Filed: Oct. 2, 1978

[51] Int. Cl.[3] ..... B31F 5/06; B65H 19/16; B65H 19/18; B65H 19/20

[52] U.S. Cl. ..... 156/157; 156/256; 156/355; 156/358; 156/361; 156/504; 156/505; 242/58.2; 242/58.4; 242/58.6; 242/59

[58] Field of Search ..... 156/157, 159, 266, 358, 156/361, 353, 504, 505, 256, 355; 242/58.2–58.4, 58.6, 59

[56] References Cited

U.S. PATENT DOCUMENTS

| | | | |
|---|---|---|---|
| 3,276,710 | 10/1966 | Zernov et al. | 242/59 |
| 3,391,877 | 7/1968 | Angell et al. | 242/58.3 |
| 3,516,617 | 6/1970 | Haner et al. | 156/504 |
| 3,904,142 | 9/1975 | Corse | 156/504 |
| 3,944,151 | 3/1976 | Lee et al. | 242/58.3 |
| 4,010,061 | 3/1977 | Tokuno | 156/504 |
| 4,111,741 | 9/1978 | Paul | 156/504 |
| 4,132,371 | 1/1979 | Byrt | 242/58.3 |

*Primary Examiner*—Jerome W. Massie
*Attorney, Agent, or Firm*—Biebel, French & Nauman

[57] ABSTRACT

A method and apparatus are provided for forming a zero tail length splice between a new roll of web material (26) and an expiring roll (24) without interrupting continuous movement of the web (W). The method includes providing a splicing strip (60) adhesively secured to the leading edge (62) of the new roll (26) and releaseably secured to the surface of the new row (26) so that it can be rotated without unwinding until it is spliced to the moving web (W) of the expiring roll (24), placing a marker (80) on the circumference of the new roll (26), which marker (80) is located a predetermined distance ahead of the leading edge (62) of the new roll in a position to be sensed by a sensing device (162), as the roll (26) is rotated adjacent the moving web (W), sensing the location of the new roll (26) relative to the surface of the moving web (W) as it is brought into close proximity with the moving web (W) and stopping its movement so that the roll (26) is held in the desired position just above the surface of the moving web (W), bringing the new roll (26) up to a rotational speed so that its surface speed matches the surface speed of the moving web (W), forcing the moving web (W) into engagement with the rotating new roll (26) at the point of closest proximity therebetween after the leading edge on the new roll (26) has passed the point of closest proximity as determined by the sensing device (162), noting the passing of the marker (80), and then further activating a cutting means (102) upon the second passing of the marker (80), for severing the moving web (W) at a distance equal to the distance along the circumference of the new roll (26) from the leading edge (62) to the point of closest proximity between the new roll (26) and the moving web (W) so that substantially a zero tail length splice is formed when the splicing strip (60) adhesively engages the surface of the moving web (W) adjacent the tail end (168) thereof.

6 Claims, 20 Drawing Figures

METHOD FOR FORMING A ZERO TAIL LENGTH SPLICE IN A MOVING WEB

BACKGROUND OF THE INVENTION

1. Field of the Invention

The present invention relates to method and means for splicing a new roll of web material into an expiring roll of web material while the web is moving.

2. Prior Art

In order that it not be necessary to shut down machinery used for processing web material such as, for example, paper coating machinery, it is advantageous to be able to splice a new roll of web material onto the moving web of the expiring roll being processed. With slow moving webs, this can be accomplished by a skilled operator manually without the need for sophisticated mechanical and electronic devices for monitoring movement of the web, and further, it can be accomplished while leaving a relatively long tail on the expiring web since the web is moving so slowly that after the splice is made, the operator can then sever the trailing edge from the moving web providing only a short overlap so as not to interfere with the subsequent processing equipment. However, as the speed of processing increases, it becomes impossible for the operator to splice the new roll of web material manually into the moving web, and either mechanical means must be used to accomplish this, or the machinery must be stopped or substantially slowed down while the splice is manually accomplished.

Several devices have been developed which accomplished splicing of the moving web. For example, such devices are disclosed in U.S. Pat. Nos. 3,276,710 and 3,253,795. The first of these utilizes a free knife blade which is mounted directly to the leading edge of the new web and its splicing strip, and which cuts through the old web after the splicing strip has been adhered to the old web with the blade then being discarded from the moving web. This forms a fairly accurate butt splice when used with certain web materials, but might not completely or smoothly sever some web materials such as those which would be highly elastic like thin plastic films, and thus has a limited use for high elasticity materials.

The other of these devices produces a lap joint between the trailing edge of the severed old web and the leading edge of the new web, which can cause processing problems in the coating or other processing equipment downstream from the unwinder/splicing equipment. Further, although this type of splicing mechanism is sensitive to roll diameter, line speed changes and consistency of knife actuation time, since no control over knife movement is maintained during knife actuation tail length accuracy is less than desired. When the diameter of the new roll is greater or less than the nominal diameter used for calculating the time interval for cutting, and when the web speed is faster or slower than the nominal web speed, the splice is not accurate and results in exposed glued area or loose tail, either of which conditions can result in damage to the downstream processing equipment or defects in the ultimate product.

SUMMARY OF THE INVENTION

The present invention overcomes the above described difficulties and disadvantages associated with such prior art devices by providing a substantially zero tail length or butt splicer which eliminates the new roll diameter as an uncontrolled variable and which takes into account the speed of the moving web during cutting so that the cutting means severs the old web at precisely the appropriate time in order that the trailing edge of the old web and the leading edge of the new web are in substantially abutting relation with the splicing strip adhering the two webs together.

This is accomplished by placing a marker on the new roll of web material at a location on the outer circumference measured along the circumferential surface a predetermined distance from the leading edge of the new web, the position of which can be sensed by a stationary sensing device as the new roll of web is rotated. After the marker is placed on the new roll of web material, it is then brought into close proximity with the moving web of the expiring roll and then rotated at substantially the same surface speed as the speed of movement of the moving web.

A web speed sensing device is positioned downstream from the splicing device in engagement with the moving web so that exact determination of web speed can be maintained. This web speed sensing device is used to operate a web cuttig knife at a faster or slower speed at a predetermined ratio to the speed of movement of the moving web. The sensing device monitors the passing of a predetermined length of web and considers the time that length takes to pass it and controls the speed of movement of the cutting knife accordingly. This control permits the length of tail on the expiring web to be established sufficiently accurately to produce a zero tail length or butt splice, if desired.

A further sensing device is positioned along the outer circumference of the new roll of web in a stationary location so that it can sense each time the marker on the outer circumference of the web passes this location. This sensing device is used to actuate a pressure roll or the like which forces the moving web into engagement with the surface of the new roll at the point of closest proximity between the new roll and the moving web, immediately after the leading edge of the new web has rotated past this position of closest proximity. This other sensing device also activates the cutting knife which is then, as mentioned above, brought into engagement with the moving web from the expiring roll at a speed related to the speed of movement of the moving web so that a smooth uniform cut is made across the entire width of the web to produce a tail of desired length.

The sensing means which monitors the passing of the marker as the new roll rotates is preferably a photoelectric device positioned adjacent the edge of the roll at the outer circumference, and is secured in fixed position to the frame of the splicing apparatus preferably at the point of closest proximity between the outer circumference of the new roll of web material and the moving web. The marker placed on the edge of the new roll of web material can be of any character which will activate the photoelectric device each time it passes.

Another sensing device, also preferably a photoelectric sensing device, can be positioned immediately adjacent the marker sensing device at the point of closest proximity between the new roll of web material and the moving web. This sensing device is used to stop the movement of the new roll of web towards the moving web when it is initially being brought into position.

Unwinding devices of the type to which the present invention relate often have an indexing head which supports both the new roll and old roll on opposite ends of the head 180° apart, and is mounted for rotation about the central portion in such a manner that the new roll can be brought into close proximity with the web from the expiring roll. With the new roll position sensing device positioned at the point of closest proximity between the new roll and the moving web, as the indexing head is rotated, the edge of the new roll passes into the sensing region of the sensing device such as a photoelectric cell, the signal from which is then used to stop rotation of the indexing head so that the edge of the new roll is in close proximity to the expiring web, but not engaging the web. The pressure roll is then used to force the moving web into engagement with the surface of the new roll at the correct time in the sequence of the splicing operation.

In accordance with the present invention, it is preferable to use an idler arm in conjunction with unwinders which have an indexing head, which idler arm has opposed arms each carrying idler rollers and cutting anvils. The idler rollers, when in position, will engage the surface of the moving web on the side opposite the splicing apparatus to position the web properly relative to the splicing apparatus for making the cut and splice. The anvil will be positioned slightly spaced above the surface of the moving web and will act as a back up surface for the web cutting knife as it cuts through the expiring web from the opposite side.

A locator arm is mounted on the splicing unit and supports the idler arm at the exact location relative to the cutting knife so that the knife and the anvil will always be properly located relative to the knife regardless of the size or location of the new roll of web material and the position of the indexing head, so that more exact control over positioning of the indexing head is not necessary.

DETAILED DESCRIPTION OF THE PREFERRED EMBODIMENTS

Figure 1:
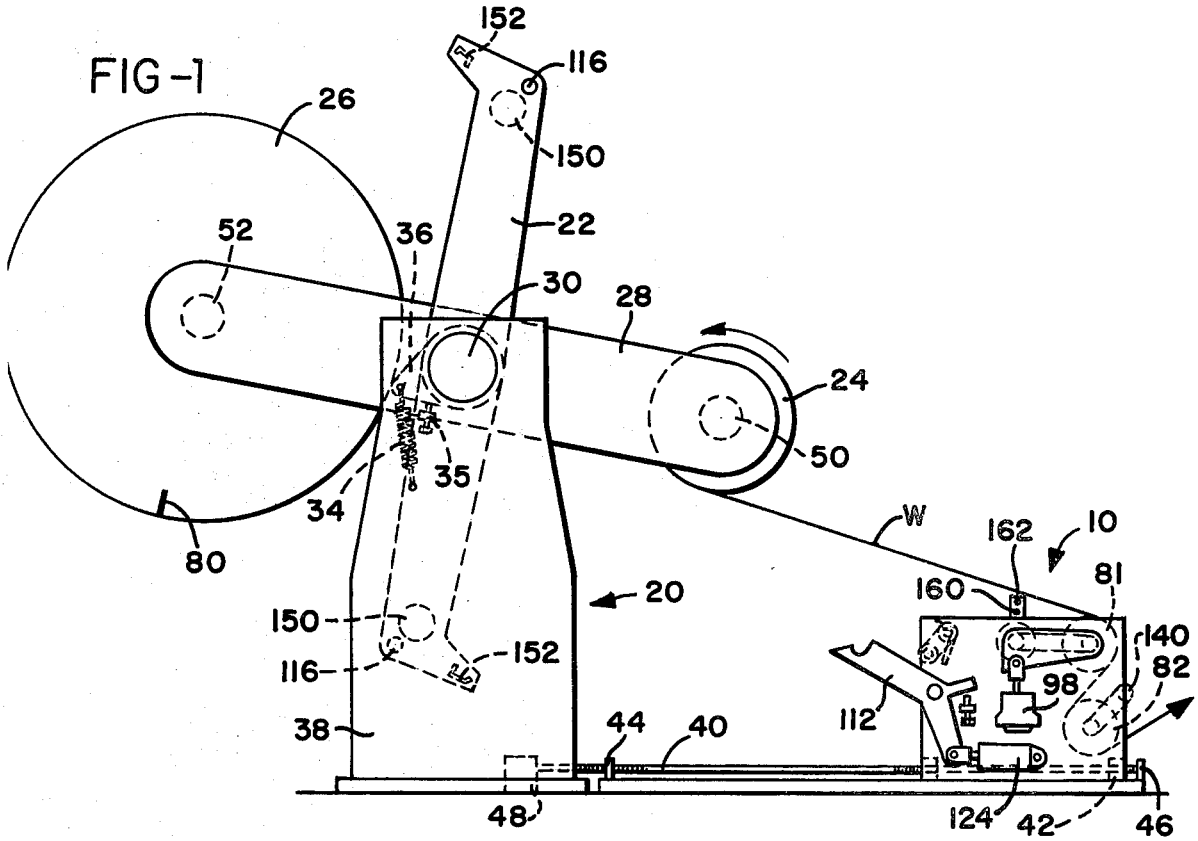
FIG. 1 is a side elevational view of the unwinder and splicing apparatus in accordance with the present invention.

As shown in FIG. 1, the overall splicing machine 10 is illustrated in position adjacent an unwind device 20 which is of generally conventional construction with the exception of a pair of idler arms 22, one on each side of the unwinder 20 outboard of the rolls of web material 24 and 26 to be unwound. It is to be understood, however, that the splicing machine 10 of the present invention can be used with other types of unwinders as well. As shown, however, the moving web W coming from the expiring roll 24 is threaded through the splicing machine 10 and the new roll 26 has just been fitted onto the turret indexing head 28 of the unwinder 20.

Figure 2:
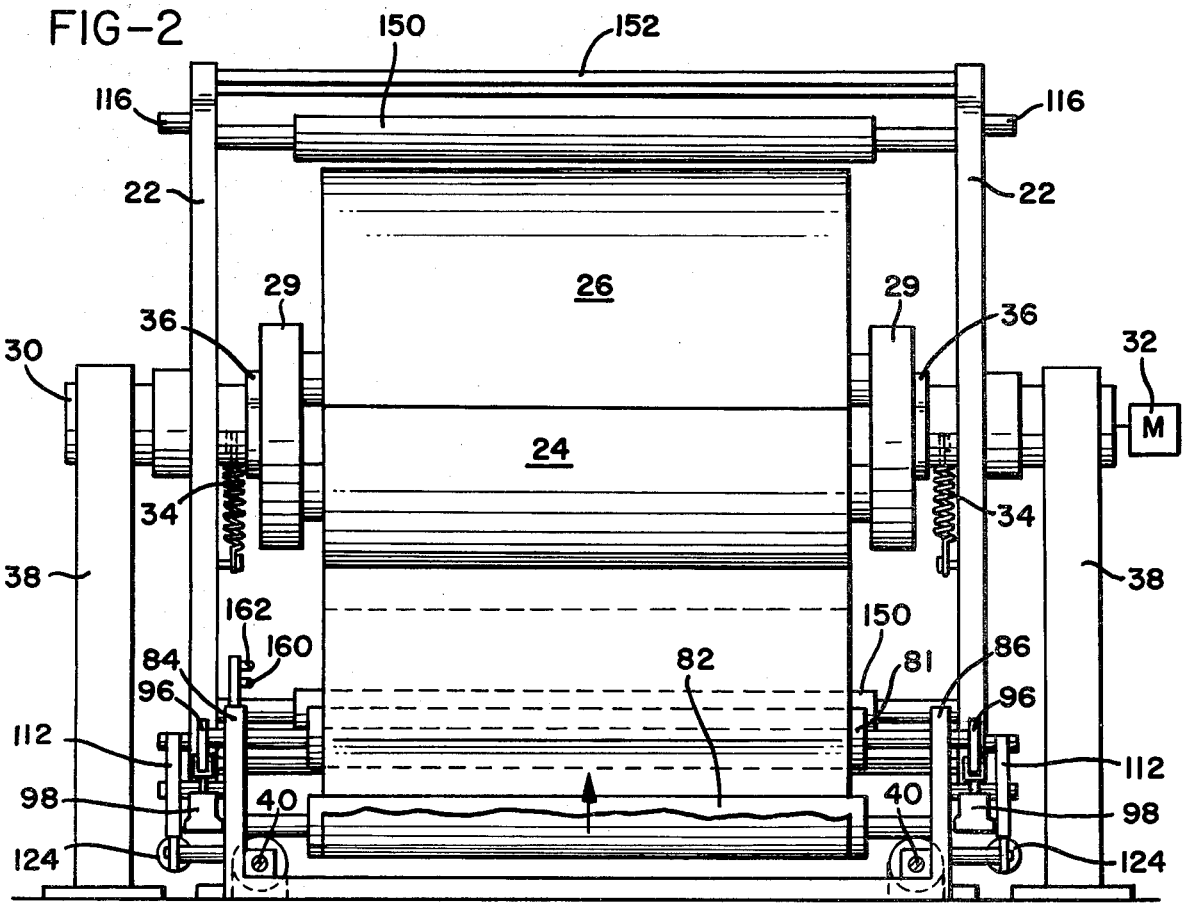
FIG. 2 is a front view of the unwinder and splicing apparatus of FIG. 1.
Figure 4:
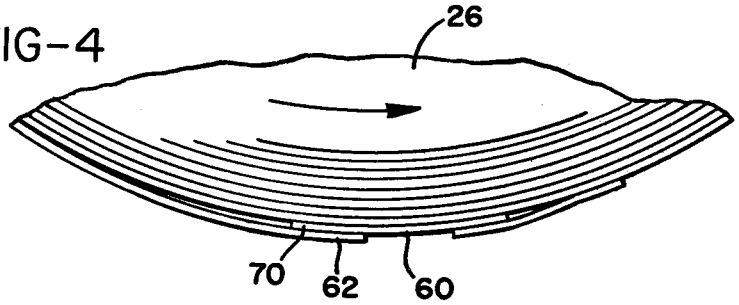
FIG. 4 is an enlarged end view of a portion of a new roll of web material prepared with a splicing strip.
Figure 10:
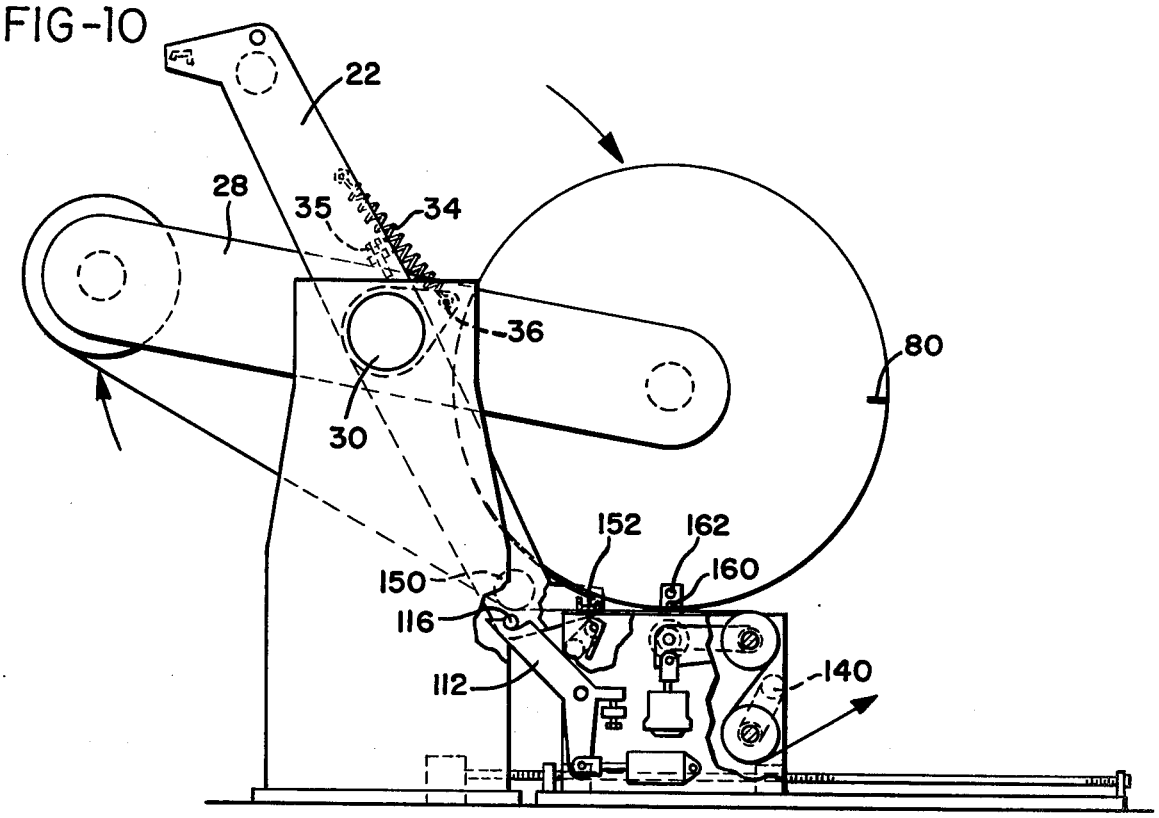
FIG. 10 illustrates the continuing rotation of the indexing head to a position where the new roll is disposed in close proximity to the moving web.
Figure 11:
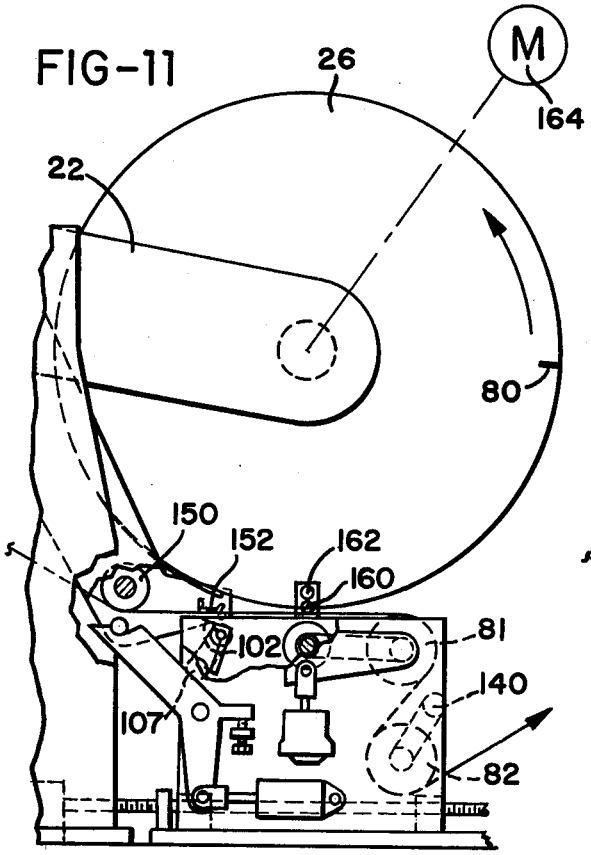
FIG. 11 illustrates the drive motor turning the central roll support shaft to bring the surface speed of the new roll up to substantially the same speed as that of the moving web.

The new roll 26 is located 180° opposite the expiring roll 24. The turret indexing head 28 is basically comprised of a pair of spaced parallel side plates 29 which are secured to the central shaft 30 for rotation therewith in a clockwise direction, as viewed in FIG. 1. Indexing head 28 is rotated by an appropriate drive means shown schematically as motor 32 in FIG. 2. Rotation of the indexing head 28 is controlled so as to bring the new roll 26 into position as illustrated in FIG. 10, for example, as is explained in more detail below.

Idler arms 22 are mounted for rotation about shaft 30, but are free to rotate independently thereof. However, they will rotate along with indexing head 28 in the relative position illustrated in FIG. 1 since they are connected through springs 34 to brackets 36 which are secured to the shaft 30 for rotation therewith. Springs 34 permit limited relative rotation between idler arms 22 and indexing head 28 which can be adjusted slightly by screw 35 secured to side plate 29 and engaging bracket 36.

The indexing head 28, idler arms 22 and shaft 30 are all supported by a stationary rigid frame structure having two opposite parallel supports 38, each supporting an end of the shaft 30 for rotation. The splicing machine 10 is movable toward and away from unwinder 20 by a pair of screw jacks 40 in cooperation with correspondingly threaded members 42 secured to the base portion of the splicing machine 10, and is moved between stops 44 and 46 which place the splicing machine 10 in proper location during operation and when not in use. The splicing machine 10 is moved between stops 44 and 46 by rotation of the screw jacks 40 by reversible motors 48 which are controlled by the operator.

The pair of spaced parallel plates 29 support at their opposite ends the expiring roll 24 and new roll 26. The expiring roll 24 and new roll 26 are supported respectively on center shafts 50 and 52 which are journaled at their end portions in plates 29.

Figure 5:
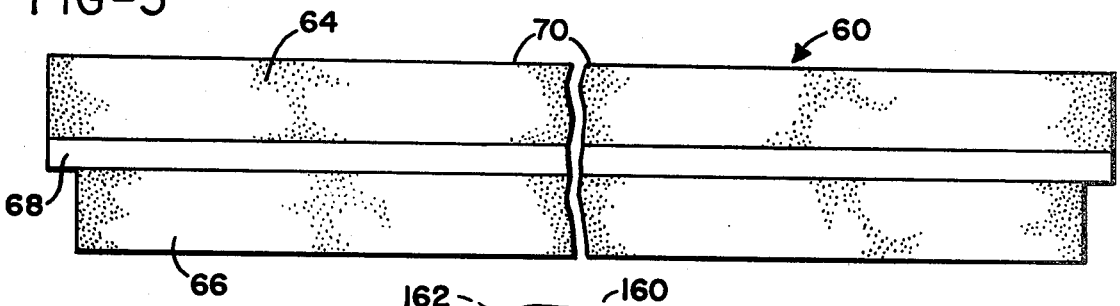
FIG. 5 is a plan view of the splicing strip which is secured to the new roll as shown in FIG. 3.

Before progressing to the description of the splicing machine 10, a brief reference will be made to the initial preparation of the new roll 26 before the splicing sequence is initiated. Referring to FIGS. 4 through 7, a splicing strip 60 of special construction is preferably used for preparing the leading edge 62 of the new roll 26 for splicing. As shown in FIG. 5, strip 60 is provided with two strips of adhesive coating 64 and 66 disposed along each edge of the splicing strip and leaving a narrow uncoated strip 68 between them. The trailing edge 70 is of approximately the same width as the new roll of web 26 and is secured by the adhesive strip 64 to the leading edge 62 of the new roll so that the uncoated strip 68 extends just beyond the leading edge 62 and is exposed along with the adhesive strip 66.

The adhesive strip 66 is slightly narrower than the width of the expiring roll of web material 24, such as for example, a half inch on each side as shown in FIG. 5, so that any misalignment widthwise of the web will not result in adhesive on the strip 66 being exposed or not engaged with the surface of the expiring web which might result in damage to the web or processing equipment downstream of the splicing apparatus. The uncoated strip 68 permits some misalignment in the joint between the expiring roll of web material 24 and the new roll of web 26 in the direction of movement of the web during splicing so that again, no adhesive will be exposed downstream of the splicing equipment.

Figure 6:
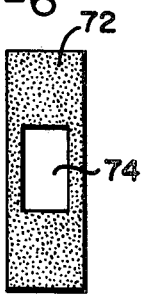
FIG. 6 is an enlarged view of the break away strip used to hold a splicing strip and leading edge of the new roll to the surface of the new roll during rotation prior to splicing to the expiring roll.
Figure 7:
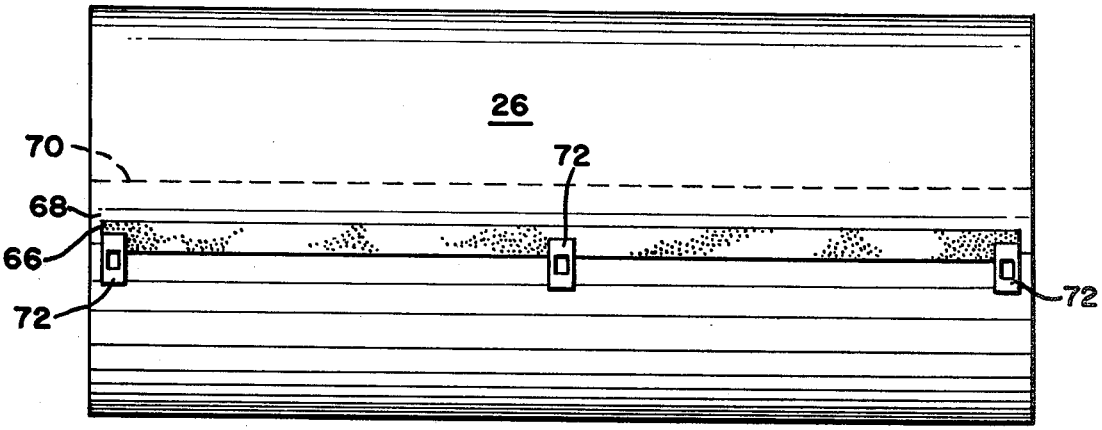
FIG. 7 illustrates the positioning of the break away strips on the splicing strips on the surface of a new roll.

In order to hold the splicing strip 60 and the leading edge 62 of the new roll of web material 26 in position when the new roll of web is being brought up to rotational speed, a series of break away strips 72 having an adhesive coating applied to its surface as shown in FIG. 6, and having a central portion of reduced cross section such as by removing the material in the center of the strip 72 leaving a rectangular open portion 74, are applied to the new roll of web material 26 as shown in FIG. 7. The strips 72 are sufficiently strong to hold the leading edge 62 and splicing strip 60 in position while the new roll of web material 26 is being brought up to speed, but will be severed when the adhesive strip 66 engages the surface of the expiring web W to make the splice as described below.

Figure 18:
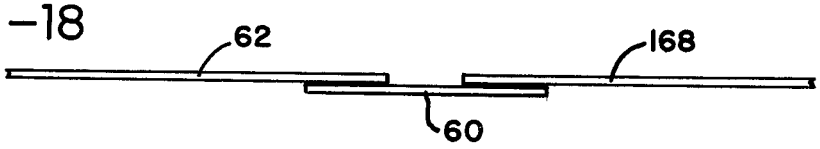
FIG. 18 illustrates a butt splice made with the apparatus and the method of the present invention with a single splicing strip.
Figure 19:
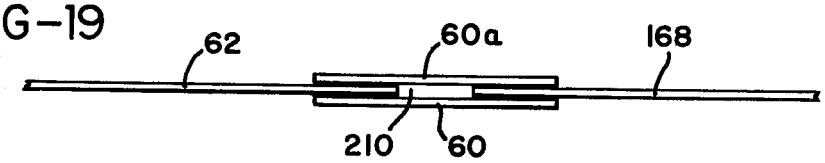
FIG. 19 illustrates a butt splice in accordance with the method of the present invention with two splicing strips positioned in registry on opposite sides of the web.

The use of the special splicing strip is particularly desirable when forming a butt splice of the type illustrated in FIGS. 18 and 19. However, in certain manufacturing processes, a butt splice is not necessary or desirable, and thus more conventional adhesive strips can be used where an overlapping tail is produced at the splicing joint which will cover up the adhesive entirely and prevent the possible problems referred to above in affecting the processing equipment downstream of the splicing machine 10.

Figure 8:
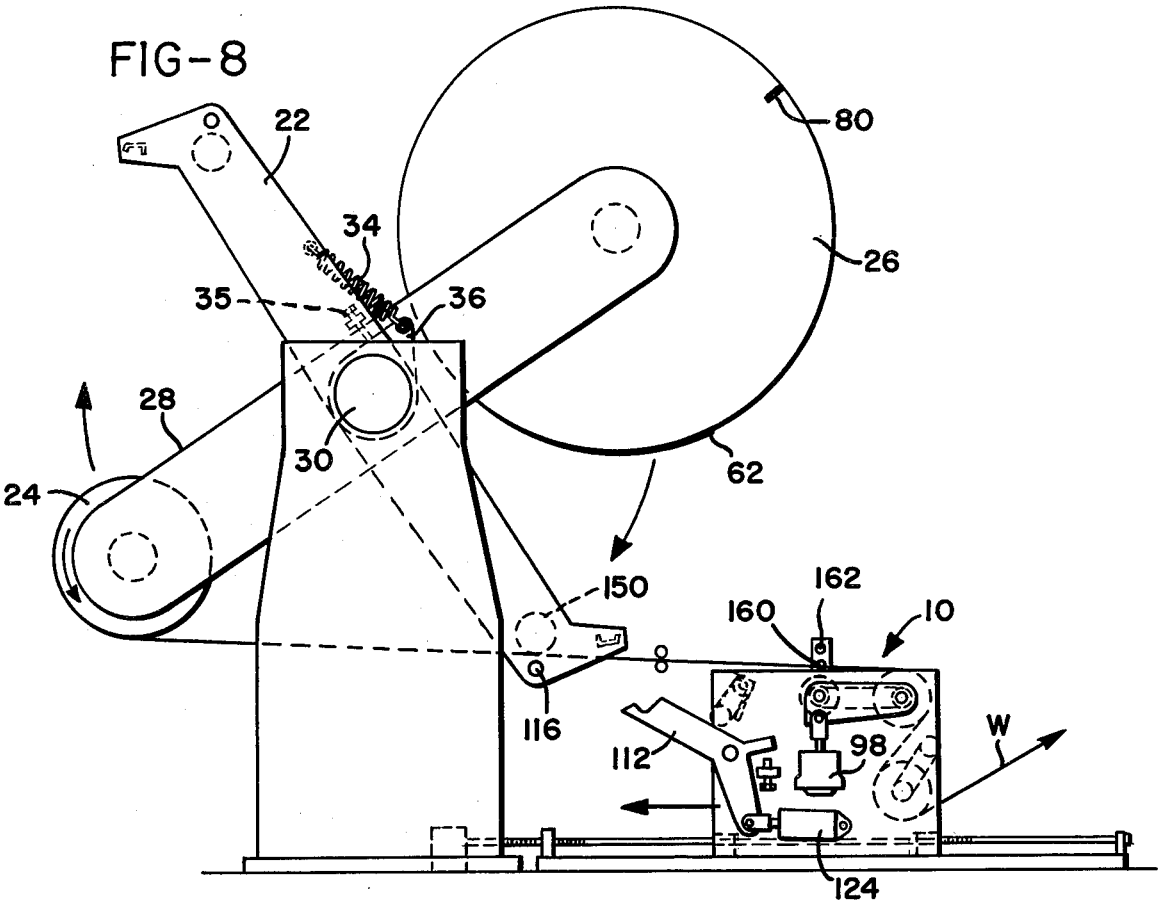
FIG. 8 illustrates the initial movement of the indexing head of the unwind apparatus and the lateral movement of the splicing device into position adjacent the unwinder.

The next step in preparing a new roll of web material 26 for the splicing operation is the positioning of a marker 80 on the side edge of the new roll 26 as seen, for example, in FIG. 8. Marker 80 can be formed of any material which can easily be sensed by a photoelectric device. It can, for example, be a piece of tape or just a scribed line, so long as it is sufficiently distinct from the rest of the roll to be sensed by the photoelectric device. Further, it can be positioned on either the edge of the roll as shown in the preferred embodiment, or on the cylindrical surface of the roll, with the photoelectric device being repositioned accordingly.

The marker 80 is positioned a predetermined distance from the leading edge 62 of the new roll, around the circumference of the new roll. The distance is established on the basis of the reasonable time required to operate the cutting mechanism from the time that the marker 80 has passed the sensing mechanism until the leading edge 62 of the new roll approaches the point of closest proximity between the new roll and the moving web W. This is a minimum time, however, and the controlling factor above this minimum time is distance or legnth of web which will move through the splicing device from the point of cutting the moving web W until it passes the point of closest proximity with the new roll 26 in order to match up with the leading edge 62 of the new roll.

Although the preferred embodiment is discussed below in connection with the forming of a butt splice, it is to be understood that in those situations where it is desirable, the marker 80 can be positioned around the circumference of the new roll 26 from the leading edge 62, a distance which will result in a tail being left on the expiring web after it has been cut and spliced. However, because of the accuracy of control with the method and apparatus of the present invention, the length of tail can be reduced to zero which produces substantially a butt splice if this is desired.

Figure 3:
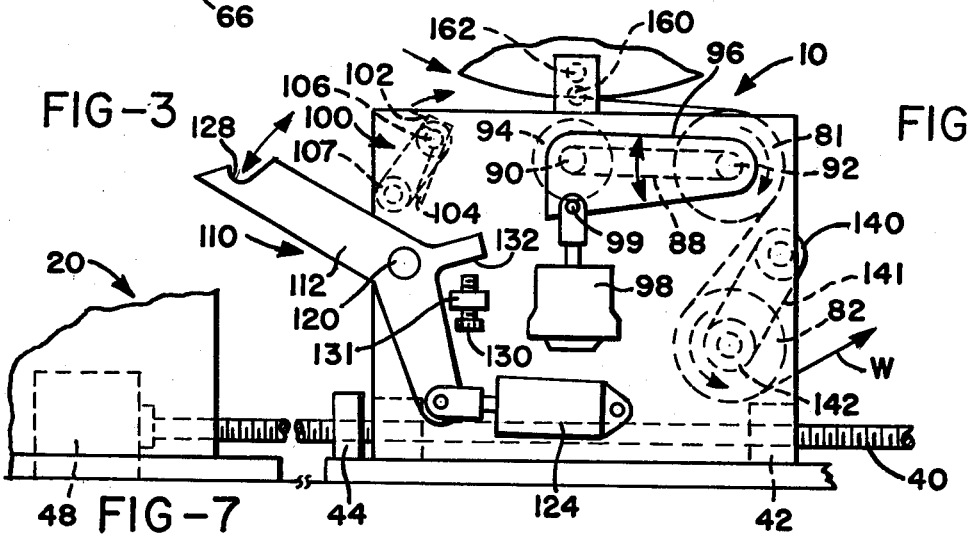
FIG. 3 is an enlarged side view of the splicing machine of FIG. 1.

Referring now to the splicing machine 10 and again to FIGS. 1, 2 and 3 in particular, the splicer 10 is provided with a pair of spaced web engaging rollers 81 and 82 which are supported by the opposite sides of the frame structure of the splicer which consists mainly of a pair of rigid plates 84 and 86 disposed in spaced parallel relation at a distance that will permit them to pass between the idler arms 22 when the idler arms are being rotated or when the splicing machine 10 is being moved into the splicing position against stops 44. The unwinding expiring web W continuously passes across rollers 81 and 82, as shown by the direction of the arrow, continuously during operation of the unwind device regardless of whether or not a splicing operation is taking place.

Roller 81 is connected through a belt 88 and pulleys 90 and 92 arrangement to a pressure roll 94. The belt and pulley arrangement is such that the surface speed of pressure roller 94 is identical to the speed of web W so that when it is forced into engagement with the web W, as described below, there will be zero relative movement between the surface of the pressure roller 94 and the web W. Pressure roller 94 is mounted at each end to a pivotal side plate 96 which pivots about the axis of roller 81 so that the pressure roller 94 can be moved up and down in an arcuate path into and out of engagement with the moving web W. A pair of double acting hydraulic or pneumatic cylinders 98 which have their pistons connected pivotally at 99 to the plates 96 are operative to move the plates 96 up and down at the appropriate time as discussed below.

A web cutting mechanism 100 extends between the side plates 84 and 86 of the splicer 10 and carries a knife blade 102 which is preferably serrated to assist in severing the web W. The knife blade 102 is supported by an angle iron 104 which also extends across the width of the web, and is pivotally mounted at 106 to each side plate 84 and 86. A low inertia induction motor 107 drives the knife blade 102 into engagement with the web at the appropriate time through the belt and pulley arrangement shown. The knife blade 102 preferably moves approximately 20 degrees, and the speed of movement through this arc is governed by the web speed as determined by the web driven position sensor described below.

Also supported by the splicing machine 10 are a pair of idler arm locator mechanisms 110 which, when the splicing machine 10 is moved into position adjacent the unwinder 20, engage respective idler arms 22 and hold them in position during the splicing operation. Each of the idler arm locator mechanisms 110 includes a lever arm 112 located on opposite sides of the splicing machine 10 outboard of the side plates 84 and 86 in a position to engage pins 116 which are secured to the idler arms 22.

Lever arms 112 are rotatable about pins 120 by means of double acting hydraulic or pneumatic cylinders 124 which are pivotally secured to one end portion of the levers 112 and can be simultaneously activated. The opposite end portion of each lever arm 112 is provided with a partial U-shaped notch 128, and the notches 128 engage the pins 116 on the idler arms 22 when the lever arms 112 are rotated into position and hold the idler arms 22 in position during a splicing operation. Adjusting screws 130 mounted in brackets 131 on the side plates 84 and 86 engage the limit stops 132 which forms a part of each lever arm 112 so that the position of the idler arms 22 can be adjusted slightly in order to place the idler arms 22 in an exact, desired position.

Control of the speed at which the knife blade 102 rotates through the 20° arc is an important aspect of the present invention. In prior art devices such as that disclosed in the above referred to U.S. Pat. No. 3,253,795, rotation or movement of the knife blade into engagement with the moving web is controlled by initiating a time delay circuit based upon some given point in time in the splicing sequence. As noted in the above referred to patent, this is not a linear relationship, but instead follows a parabolic curve and thus means must be used to adjust the timing of initiation of a cutting stroke with a given period of movement from its retracted position to its cutting position.

In addition, it has been discovered that it is advantageous to engage the web at substantially web velocity, which cannot be accomplished by prior art devices such as mentioned above, except by accident or by design for a single given web speed. Having the knife blade 102 engage the web W at substantially the speed of movement of the web produces a cleaner cut, particularly in more difficult to cut materials.

Thus in the present invention, the low inertia motor 107 is of the variable speed type whose speed is then controlled in proportion to the speed of the moving web so that the blade strikes the web preferably at substantially web speed.

Looking at it in a slightly different manner, it can be considered that the knife 102 is position-controlled based upon a given length of web material which passes over a monitoring device that provides an indication of the rate of movement of the material, which in turn is used to control the speed at which the knife blade is rotated through the 20° arc so that it will engage the web at exactly the end of the given length of web, preferably at web velocity. In order to sense the movement of the web, a web speed sensing device 140 is provided which generates a series of pulses based upon the rotation of roller 82 to which it is connected via the belt 141 and pulley arrangement 142.

Figure 20:
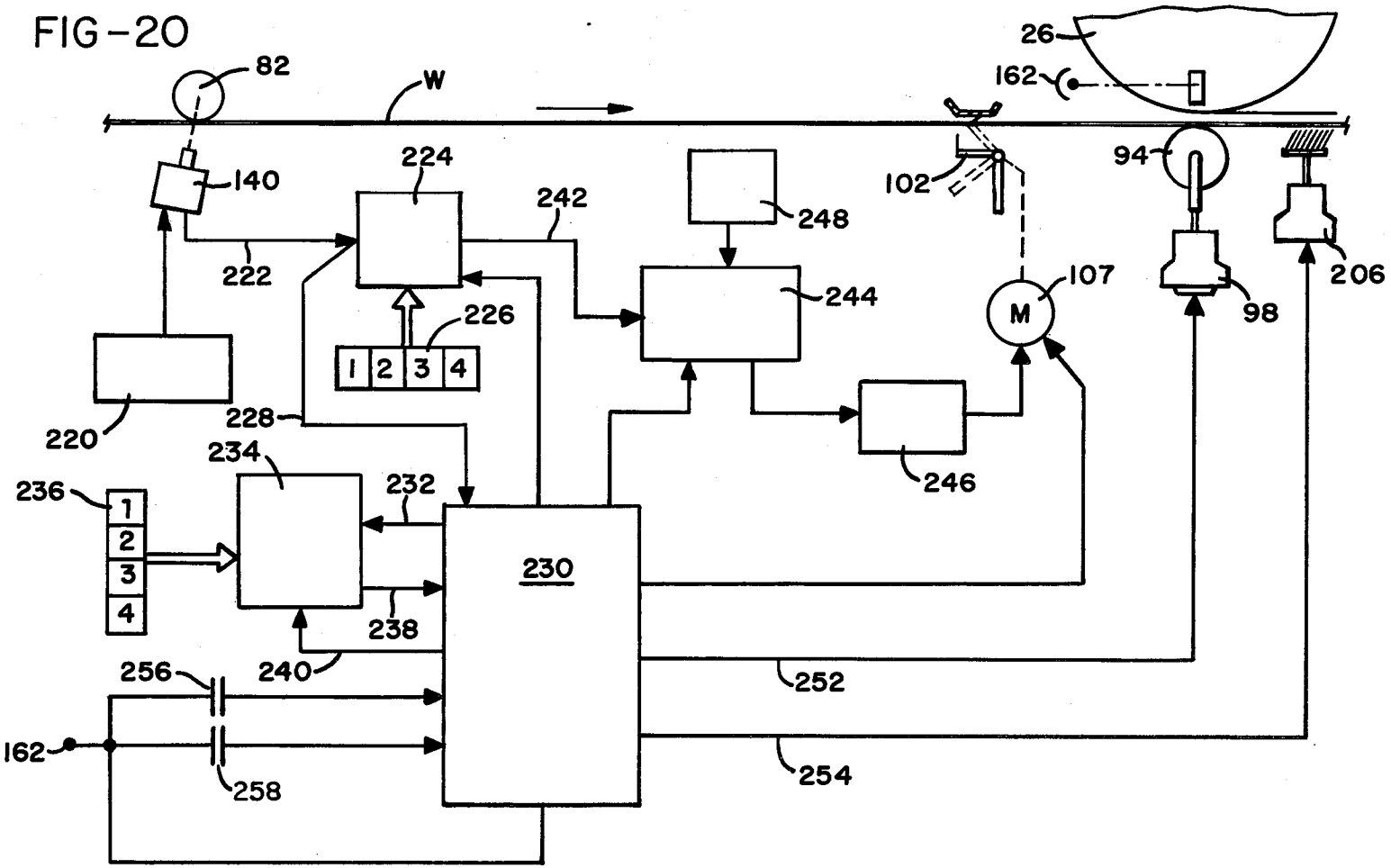
FIG. 20 is a schematic wiring diagram of the splicing operation control circuitry of the preferred embodiment.

Generally, the web speed sensing device 140 generates a series of electrical pulses based upon a given length of web material W passing over roller 82 as it rotates. The time between pulses is established by a given length of web moving over the surface of roller 82. Thus it can be seen that as the web moves faster, the pulses will be generated more frequently. These pulses are then used to control speed of motor 107 and thus the movement of knife blade 102. Provision is also preferably made for constantly monitoring the speed of movement of the web while the knife blade is being rotated so that adjustment in speed of rotation of the knife blade 102 can be made while it is being rotated. A system for providing this function is illustrated in FIG. 20 and discussed in detail below.

Thus it can be seen that the knife blade rotation control system permits a given length of web to pass over the sensing device before it is severed by a knife blade 102. This given length of web can then be correlated to the rotation of the new roll of web material and the distance from the timing marker 80 to the leading edge 62 of the new roll, in order to match the leading edge with the trailing severed edge of the moving web.

Referring again to the idler arms 22, they are provided with a pair of idler rollers 150, one each extending between adjacent ends of idler arms 22 at each end thereof, so that upon rotation of the idler arms 22, one of the rollers 150 will engage the upper surface of the expiring web W. A backing plate or anvil 152 is also secured at each end of the idler arms 22 adjacent each roller 150 and against which the cutting knife 102 presses the web W when it is cut, in order to provide a constant cutting point across the width of the web for more accurate splicing.

It is recognized that with some materials, the back up anvil 152 may not be necessary since they can be uniformly cut without the anvil 152. In any event, when the idler arms 22 are rotated into position and the idler arm locator mechanisms 110 engage the pins 116, they will hold the idler roller 150 in engagement with the surface of the expiring web W, and the anvil 152 will be properly positioned opposite the cutting knife 102, as seen in FIG. 10. In order that the position of the idler arms 22 may be adjusted by movement of the idler arm locator mechanisms 110, the springs 34 are provided. These permit the idler arms 22 to be moved counterclockwise relative to the indexing head 28 so that the anvil 152 will be properly located.

Mounted on top of one side plate 84 of the splicing device 10 are a pair of vertically spaced photoelectric sensors 160 and 162 preferably of the high frequency, infrared type. Sensor 160 is connected through circuitry (not shown) to the control mechanism for rotation of indexing head 28 so that when the outside edge of the new roll 26 comes within the sensing path of sensor 160, it automatically stops rotation of indexing head 28 to position the new roll of web material 26 immediately above the surface of the moving web W extending from the expiring roll 24.

The new roll 26 is stopped preferably approximately ¾ of an inch above the surface of the moving web W as shown in FIG. 10. After the new roll of web material 26 has been brought into this position of close proximity to the moving web W the new roll of web material is brought up to the same surface speed as the web speed W such as by the use of a surface speed tachometer and manual adjustment of the speed of motor 164.

Figure 9:
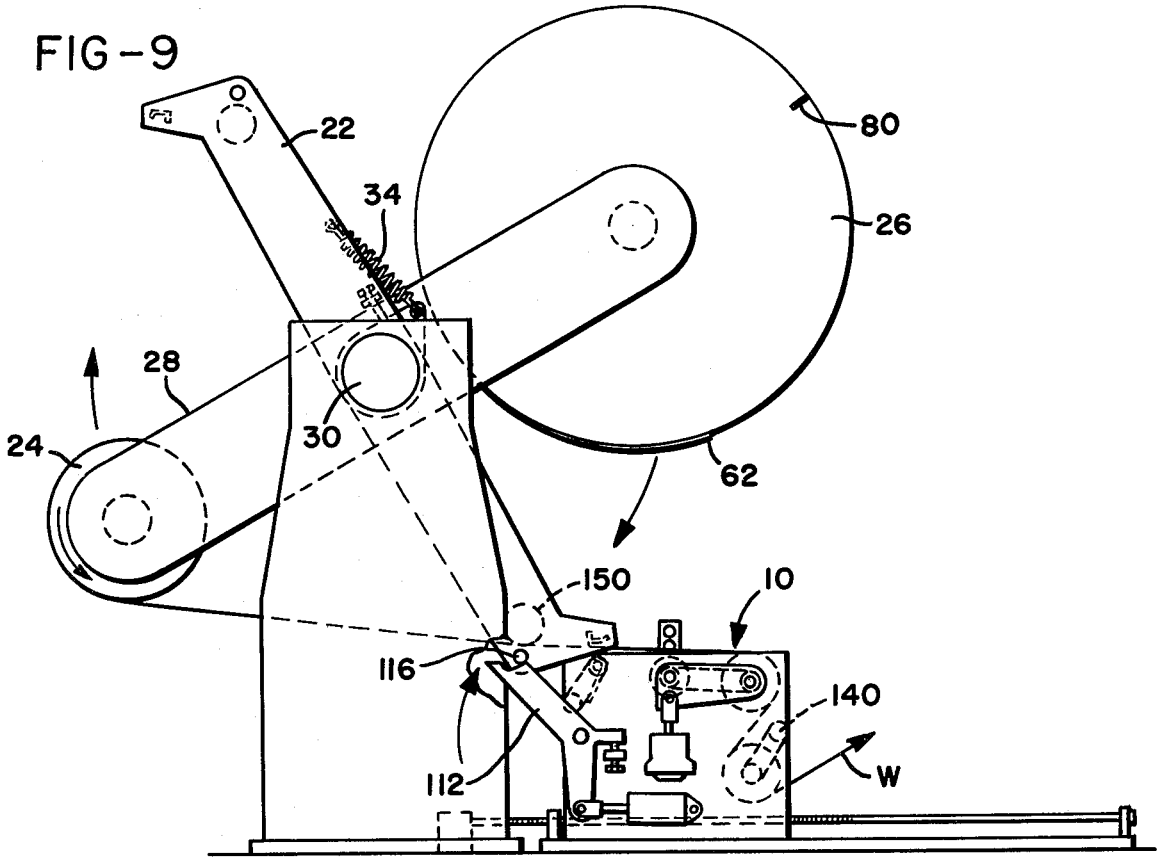
FIG. 9 illustrates the rotational movement of the idler arm locator to properly position the idler arm relative to the moving web.

Referring now to the sequence of operation as illustrated progressively in FIGS. 8–15, after the new roll of web material 26 has been prepared in advance as described above, and positioned on one end of the indexing head 28 supported by shaft 52 as shown in FIG. 1, it is then rotated by clockwise movement of indexing head 28 toward the expiring web W while the expiring roll of web material 24 is moved out of the way as illustrated in FIG. 8. At approximately the same time of rotation of the indexing head 28 to bring idler arms 22 into approximate position for idler roller 150 to engage the surface of the moving web W, the splicer 10 is also moved rearwardly, in the direction of the arrow in FIG. 8, by screw jacks 40 until it comes into engagement with the rear stops 44. At that point, as shown in FIG. 9, as the indexing head 28 continues to rotate clockwise, the idler arm locator arms 112 are moved upwardly to engage the pins 116 on each side of the unwinder 20 in order to position the anvil 152 properly opposite the cutting knife 102 as described above.

As indexing head 28 continues to rotate clockwise, the outer circumferential edge of new roll 26 passes into the sensing region of sensor 160, which causes the rotation of the indexing head 28 to be stopped just above the surface of web W. With the new roll of web material then held in this position, the motor 164 causes the new roll 26 to be brought up to a surface speed which is substantially the same as the surface speed of the moving web W.

Once the surface speed of roll 26 has been brought up to substantially the same speed as web W, the photoelectric sensor 162 can be either manually or automatically activated to begin sensing the passing of marker 80 on the edge of the new roll of web material 26 adjacent the outer circumference thereof in a position which will pass through the sensing area of sensor 162. Upon sensing of the marker 80 by sensor 162, hydraulic cylinder 98 is activated which in turn forces pressure roller 94 upwards into engagement with the lower surface of the moving web W, and further forces the moving web W upwards into engagement with the surface of the now rotating new roll of web material 26. Since, as mentioned above, both the surface of the pressure roller 94 and the surface speed of the new roll of web are moving at substantially web velocity, a smooth engagement of the three will occur.

Marker 80 is positioned around the circumference of the new roll 26 a given distance from the leading edge 62. The timing between sensing of marker 80 by sensor 162 and movement of roller 94 should be such that pressure roller 94 does not cause engagement between the moving web W and the surface of the new roll of web material 26 until the leading edge 62 has passed the point of closest proximity between them, i.e. where they will engage one another. Otherwise, the exposed adhesive strip 66 would prematurely engage the surface of the moving web W before it has been cut by the knife 102.

Figure 12:
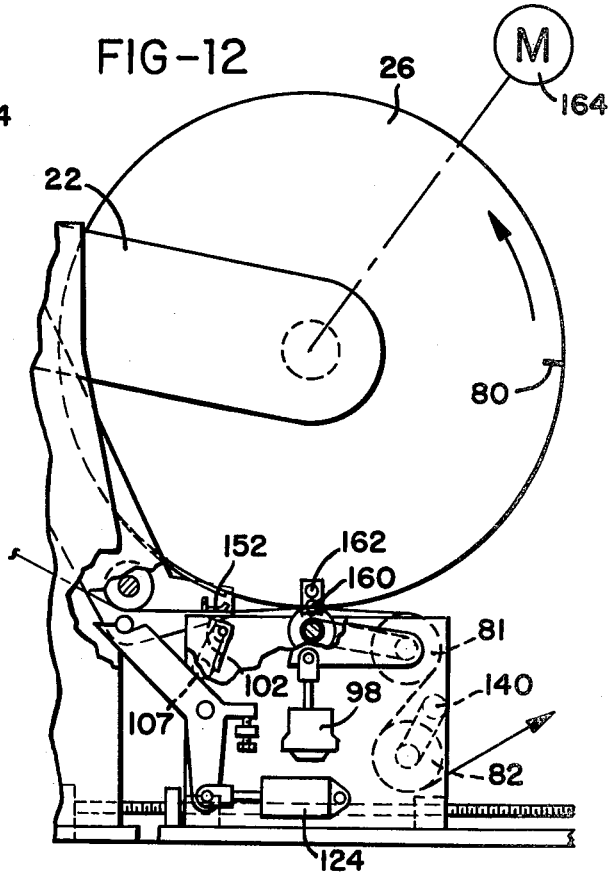
FIG. 12 illustrates the pressure roll forcing the moving web into engagement with the new roll.
Figure 13:
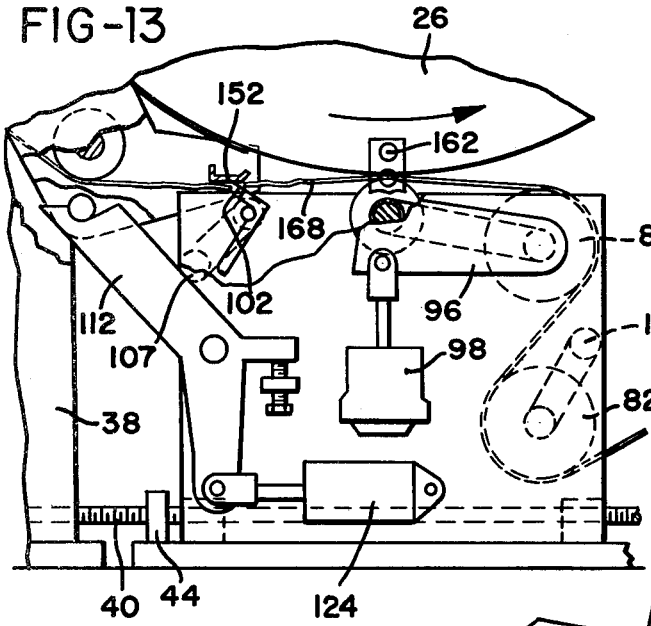
FIG. 13 illustrates severing of the moving web with the cutting means.
Figure 14:
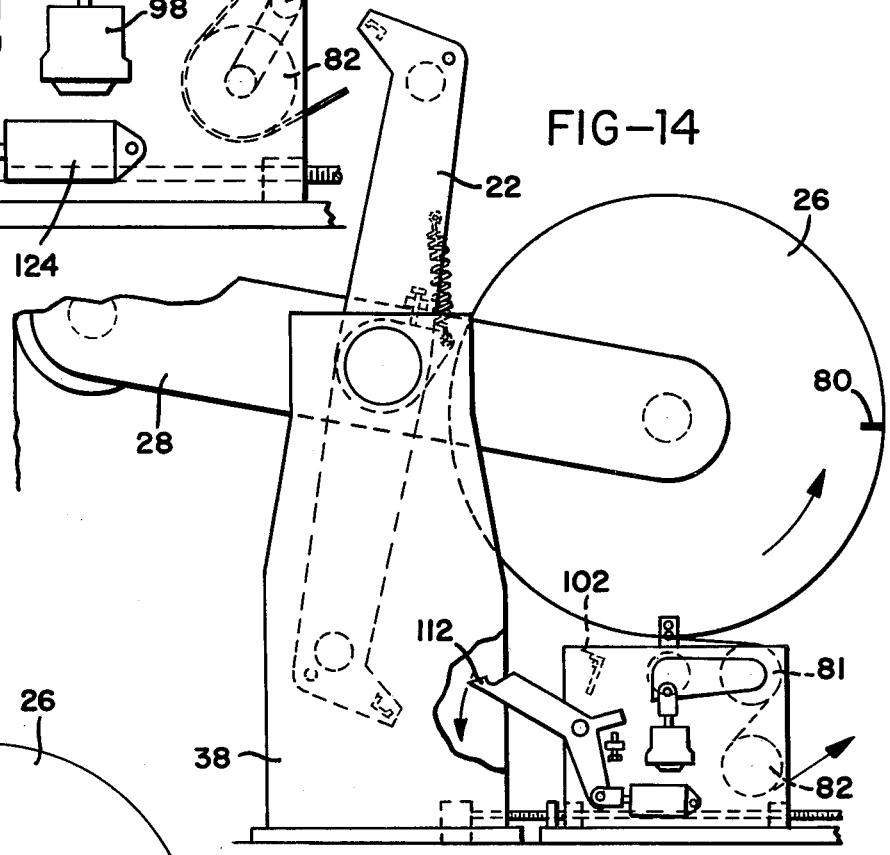
FIG. 14 illustrates retraction of the idler arm locator and movement of the idler arm into a retracted position.

Referring to FIG. 12, after the pressure roller 94 has engaged the web W and in turn caused it to engage the surface of the new roll of web material 26, the marker 80 will again pass through the sensing region of the sensor 162 which will then activate the cutting means 100 so that the knife blade 102 will sever the web W. In the example illustrated, the length of the tail 168 from the point of engagement of the web W with the new roll 26 to the cutting blade 102 is substantially the same as the distance of the leading edge 62 from the point of engagement so that as the two ends approach the point of engagement they will be in a substantially abutting relation.

After activation of the cutting mechanism 100, which in effect is activation of the low inertia motor 107, the knife 102 will be rotated into engagement with the surface of the web W at a speed determined by the position sensing device 140 as described above. The blade will then force the web W into engagement with the anvil 152 and cause the web W to be severed with the predetermined length of tail 168 from the point of closest proximity between the new roll of web material 26 and the moving web W.

When the severed tail portion 168 of the moving web and the leading edge 62 of the new roll of web 26 pass between the pressure roller 94 and the new roll of web material 26, the pressure between the two will cause the adhesive portion 66 of the splicing strip 60 to adhere to the tail portion 168 of the moving web W so that the very end portion thereof will be in substantially abutting relation with the leading edge 62 of the new roll of web material, for example as shown in FIG. 18. The newly joined web which will now be extending from the new roll of web material 26 will then pass through the rollers 80 and 82 into the subsequent processing machinery (not shown) with no tail section to interfere with the processing machine, or exposed adhesive portion which might damage the machinery or interfere with the coating or other processing of the web material.

Figure 15:
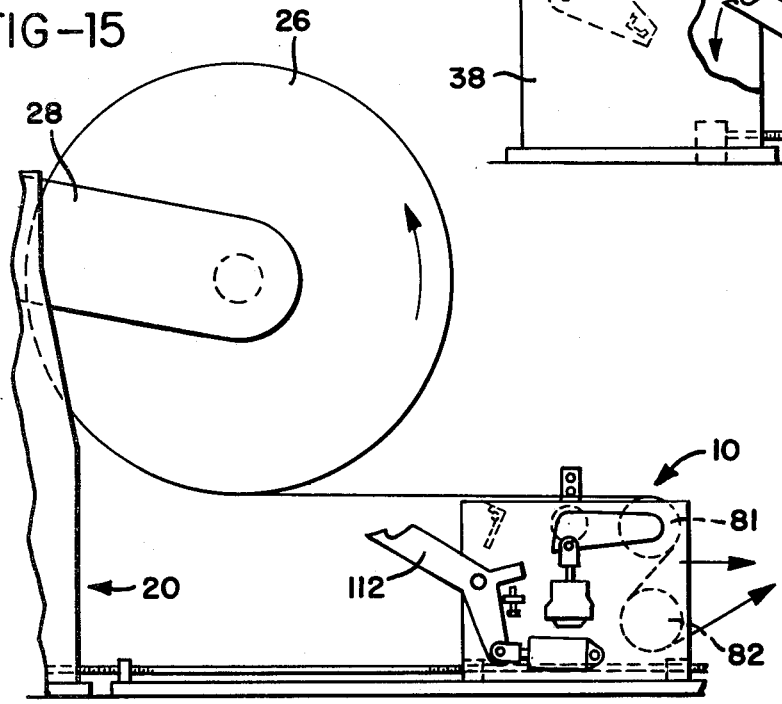
FIG. 15 illustrates the splicing apparatus being moved laterally away from the unwinding apparatus.

After the splice has been completed, the idler arm locator arms 112 are retracted by hydraulic cylinders 124 so as to release pins 116 and permit idler arms 22 to rotate counterclockwise under the biasing force of spring 34 until the stop screw 35 comes in contact with the bracket 36 where it will maintain its position relative to the indexing head 28 during rotation of the indexing head. As shown in FIG. 15, the splicing machine 10 is then moved to its inoperative position against stops 46. The movement of the splicing machine 10 to this inoperative position is provided so that if it is desirable to remove a roll that is only partially expired, the roll can be rotated clockwise with the indexing head past the operative position of the splicing machine. Otherwise, the indexing head cannot be rotated with a partially expired roll since the splicing machine would be in the way of the path of movement.

Figure 16:
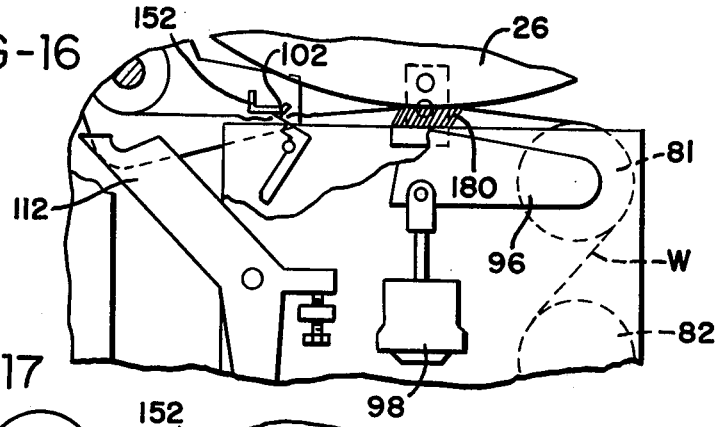
FIG. 16 illustrates an alternative construction to the pressure roller utilizing a brush to urge the moving web into engagement with the surface of the new roll.
Figure 17:
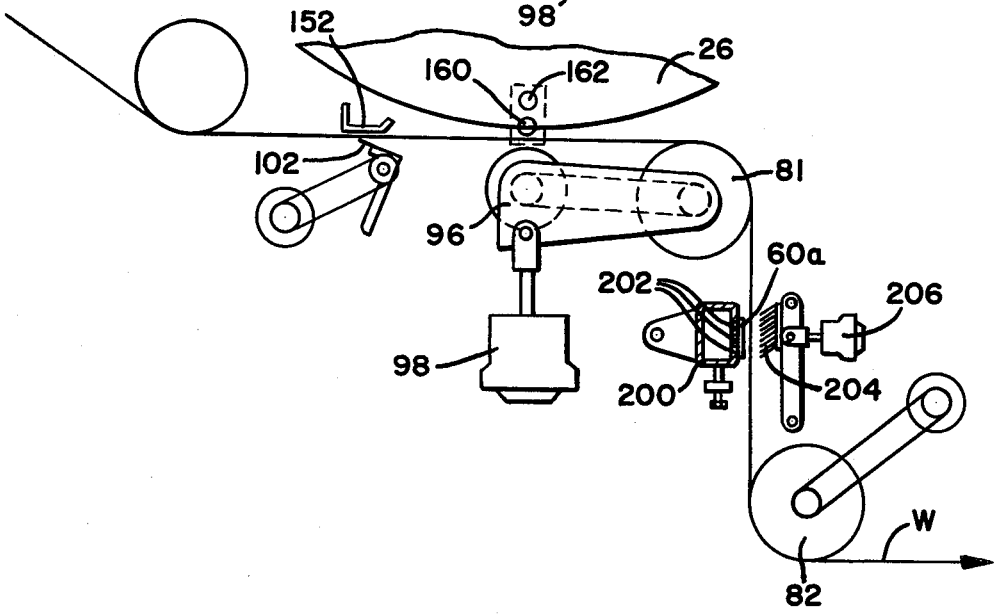
FIG. 17 illustrates apparatus for applying a second splicing strip on the opposite side of the web from the splicing strip applied when the initial splice is made.

In FIG. 16 is illustrated an alternative to the pressure roller 94 described above. In this embodiment, a relatively stiff bristle brush 180 has been substituted for the pressure roller 94, but is otherwise engaged with the lower surface of the moving web W and in turn causes the moving web to be engaged with the new roll of web material, in essentially the same manner as described above for the pressure roller 94.

Use of the brush 180 has the advantage of eliminating the drive connection via belt 88 and pulleys 90 and 92 to the web driven roll 81 since the brush 180 does not have to be rotated at line speed. In addition, the bristles bend sufficiently that a path of conformity to the surface of the new roll at the point of engagement between the expiring web W and the new roll will be established rather than the line contact which exists with the pressure roller 94. Further, the brush is made of much lighter weight material than the pressure roller 94 and can thus be engaged much more rapidly and also reduces the possibility of bouncing which exists with the pressure roller 94 when it is rapidly engaged with the new roll of web material.

Sometimes it is desirable to provide a butt splice, such as illustrated in FIG. 19, where a splicing strip 60*a* is secured to the back side of the web W opposite the splicing strip 60 which has been adhered to the web in the manner described above. In order to apply the second splicing strip 60*a*, a mechanism such as that illustrated in FIG. 16 is provided downstream from the pressure roller 94 which is positioned to apply the second splicing strip 60*a* to the opposite side of the web W from that to which the splicing strip 60 has been applied.

The mechanism illustrated herein includes a means for holding the second splicing strip 60*a*, such as a vacuum conduit 200 with a plurality of holes 202 in the face thereof which can hold with a vacuum the second strip 60*a* in position adjacent the back side of the web W. On the opposite side of the web is a pivotally mounted brush 204 which is pivotally moved toward and away from the member 200 by a pneumatic or hydraulic cylinder 206 so that the web W will be forced into engagement with the splicing strip 60*a* upon command. The cylinder 206 is activated by the web speed sensing device 140 which continues to monitor the movement of the web after the splicing operation has been performed. The control circuitry, as described in connection with FIG. 20, is programed to activate the cylinder 206 as the position of the splice on the web W passes.

As the splicing strip 60 passes between the brush 204 and splicing strip 60*a*, the brush will force the web W into engagement with the strip 60*a* and the vacuum will be released so that the splicing strip 60*a* will then adhere to the opposite side of the web from that to which the strip 60 is secured, thus making the dual butt splice of the type illustrated in FIG. 19. It is to be noted in such a case, it is not necessarily important to prevent adhesive from extending between two ends of the new web and the old expired web in the area 210 as illustrated in FIG. 19, since the two splicing strips 60 and 60*a* will cover this area entirely.

Referring now to the control circuitry for the low inertia motor 107 which rotates the knife 102 into cutting engagement with the web W, it is shown schematically in FIG. 20 along with schematic illustrations of various components of the system laid out in a linear position to more clearly illustrate the functioning sequence. The roll 82 is positioned a predetermined distance along the surface of the web W from the point of closest proximity between the new roll of web material 26 and pressure roller 94. It is to be noted that in FIG. 20 the position of roll 82 is upstream of the splicing operation whereas in the preferred embodiment illustrated in FIG. 1 the roll 82 is downstream of the new roll of web material. The roll 82 has been repositioned in this manner for the sake of diagramatic clarity, but will otherwise function in the same manner as it would in the desired position illustrated in the preferred embodiment.

The roll 82 is mechanically coupled to the web speed sensing device 140 which is an encoder producing a series of pulses as roll 82 rotates. For example, the web speed sensing device 140 can generate 500 pulses per revolution of roll 82. A power supply 220 is connected to the web speed sensing device 140 in order to permit the generation of electrical pulses by the web speed sensing device, which pulses are passed through line 222 to a rate multiplier unit 224. The rate multiplier unit 224 is adjustable by a manual adjustment means 226 to permit the incoming pulses to be multiplied at a rate greater or less than one depending on the length of tail desired on the splice being made. Such a unit can be obtained from Control Systems Research, Inc., Pittsburgh, Pa., and is designated as an RMU-T-1. The signal then generated by the rate multiplier unit is transferred by line 228 to a logic interface member 230 and passed from there by line 232 to a pulse accumulator 234 which can be manually adjusted by means 236 to trigger an output signal through line 238 at a given accumulation of pulses corresponding to a desired length of web movement between the position of the knife 102 and the pressure roller 94 as explained more fully below.

The pulses generated by the rate multiplier unit are passed through line 242 to a servo translator 224 in the form of an analogue position transducer such as that available from Control Systems Research, Inc. and designated ST-70J-3 with a zero lag option and 1000 pulse per revolution capability. The servo translator 244 provides direct control cover the drive motor 107 of the knife 102, through a tachometer and resolver feedback circuit 246, which combined with the motor is also obtainable from Control Systems Research, Inc. and designated SM 707. This combination of resolver and transducer feedback with the motor 107 permits determination of exact position of the shaft of the motor at a given time and thus permits exact control of the speed of movement of knife blade 102 as pulses are received from the rate multiplying unit directly into the servo transducer through line 242.

The power supply 248 provides the power for operating the motor 107 and is controlled by the servo translator 244 to produce adjustment in the movement of the motor based on the pulse rate receipt from the rate multiplier unit 224.

A preset trigger signal is provided from member 230 through line 240 to load the accumulator with a preset number of pulses corresponding to the desired output from the pulse accumulator 234 which is adjustable by the means 236 so as to preload the accumulator with sufficient pulses to correspond to a given amount of web movement in order to cause an output from accumulator 234 through line 238 back into the member 230.

As mentioned above, the movement of the pressure roll 94 is controlled through this circuitry and, as illustrated, is provided with a control signal through line 252 from the member 230 which, upon sensing sufficient movement of the web which is established on the basis of a predetermined accumulation of pulses in accumulator 234 after sensing of the marker 80 by the photoelectric device 162, produces a signal which activates hydraulic cylinder 98 forcing roller 94 upwards causing engagement of the web W with the new roll 26. Likewise, the hydraulic cylinder 206 is activated a further predetermined distance of movement of web W, also established by accumulator 234, so that as the splice passes the position of brush 204 it will be forced into engagement with the web causing the second splice to be effected on the opposite side from the first splice if this option is desired. After a period of activation of the knife blade 102, the hydraulic cylinder 98, or the hydraulic cylinder 206, which corresponds to movement of the web W sufficient to affect the given operation associated with each of these devices, the member 230 will cause each of these devices to return to their home or retracted position.

Activation of the system generally is controlled by the on-off switch 256 which is activated by the operator and which activates the control logic member 230 to pass the pulses therethrough as described above. Further, as noted above, the marker 80 must be sensed twice, with the first sensing producing upward movement of the pressure roller and the second sensing causing upward movement of the knife. The first sensing is introduced to the logic control member 230 through the switch 258 which is connected to the photoelectric device 162 and which arms the control member 230 to permit receipt of the signals from the rate multiplying unit 224.

In operation, it can be seen that by the use of this type of circuitry described in connection with FIG. 20, exact positioning of the knife 102 can be maintained in relation to web movement even during movement of the knife 102 and thus much greater accuracy of position of the cutting of the web relative to the splicing station, i.e. roll 94, can be maintained than in prior known systems.

Although the foregoing illustrates the preferred embodiment and method of the present invention, other variations are possible. All such variations as would be obvious to one skilled in this art are intended to be included within the scope of the invention as defined by the following claims.

What is claimed is:

1. A method of joining a leading edge of a new roll of web material onto a moving web from an expiring roll of web material, the steps comprising:

placing a mark on said new roll of web at a location along the outer circumference a predetermined circumferential distance from said leading edge:

securing a splicing strip to said leading edge with an adhesive portion extending beyond said leading edge so as to be engagable with said moving web;

releasably securing said splicing strip and said leading edge to the surface of said new roll;

positioning said new roll immediately adjacent said moving web so that said leading edge and splicing strip when unwound will move in the direction of movement of said moving web;

rotating said new roll of web so that the surface speed thereof is substantially the same as said moving web;

sensing the passing of said mark at a fixed location around the circumference of said new roll of web so as to locate the position of said leading edge relative to the point of closest proximity of said new roll of web and said moving web;

forcing said moving web at said point of closest proximity into engagement with said new roll of web a sufficient time after said sensing of said mark to allow said leading edge to pass said point of closest proximity;

securing a web cutting blade to a rotatable shaft driven by a motor;

initiating movement of said web cutting blade towards said moving web by rotating said shaft upon sensing the passing of said mark at said fixed location;

continuously monitoring the angular position of said shaft;

continuously monitoring web speed;

correlating said web speed with said angular position of said shaft;

continuously adjusting the speed of rotation of said shaft in response to change of said web speed so that said blade contacts said web at substantially web speed and severs said web at a predetermined distance from said point of closest proximity when said leading edge is substantially the same or greater circumferential distance from said point of closest proximity; and pressing said adhesive portion of said splicing strip into engagement with the cut trailing edge of said moving web by a pressing means at said point of closest proximity.

2. A method as defined in claim 1 wherein said step of placing said mark on said new roll includes:

positioning said mark around the circumference from the leading edge of said new roll a sufficient distance that said web can be severed at a distance from said point of closest proximity equal to or greater than the circumferential distance from said leading edge to said point when said mark is being sensed at said fixed location.

3. A method as defined in claim 1 wherein the step of placing said mark on said new roll includes:

positioning said mark around the circumference of said new roll at a distance from the leading edge a sufficient distance that the severing of the web can be accomplished within the period of time it takes the new roll to rotate from a position in which said mark is at said point of closest proximity to said web, to a position in which said leading edge is at said point of closest proximity.

4. A method of joining a leading edge of a new roll of web material onto a moving web from an expiring roll of web material, the steps comprising:

placing a mark on said new roll of web at a location along the outer circumference a predetermined circumferential distance from said leading edge;

securing a splicing strip to said leading edge with an adhesive portion extending beyond said leading edge so as to be engagable with said moving web;

releasably securing said splicing strip and said leading edge to the surface of said new roll;

carrying said new roll and said expiring roll on an indexing head rotatable about an axis transverse to the plane of said web, said indexing head further carrying an anvil associated with each said roll;

rotating said indexing head until said new roll is disposed adjacent said web so that said leading edge and splicing strip when unwound will move in the direction of movement of said moving web, and said anvil associated therewith is disposed on the opposite side of said web and in registry with a web cutting blade for severing said web;

rotating said new roll of web so that the surface speed thereof is substantially the same as said moving web;

sensing the passing of said mark at a fixed location around the circumference of said new roll of web so as to locate the position of said leading edge relative to the point of closest proximity of said new roll of web and said moving web;

forcing said moving web at said point of closest proximity into engagement with said new roll of web a sufficient time after said sensing of said mark to allow said leading edge to pass said point of closest proximity;

initiating movement of said web cutting blade towards said moving web upon sensing the passing of said mark at said fixed location;

continuously adjusting the speed of said blade in response to change of said web speed so as to contact said web with said blade at substantially web speed and force said web into said anvil and sever said web at a predetermined distance from said point of closest proximity when said leading edge is substantially the same or greater circumferential distance from said point of closest proximity; and pressing said adhesive portion of said splicing strip into engagement with the cut trailing edge of said moving web by a pressing means at said point of closest proximity.

5. A method as defined in claim 4 including the steps of:

engaging said indexing head with an anvil locator when said new roll and said anvil are rotated into position adjacent said web, for aligning and holding said anvil in position during severing of said web; and disengaging said locator after said severing stop.

6. A method as defined in claim 5 or 1 including the steps of:

continuing to monitor the movement of the splice between said leading edge and said trailing edge after it leaves said pressing means;

activating a further pressing means down stream of the first said pressing means and on the opposite side of said web therefrom, when said splice is monitored to be in registry therewith; and applying with said further pressing means a further splicing strip having an adhesive portion to said opposite side in registry with the first said splicing strip.

* * * * *